US010543708B2

(12) United States Patent
Tojima et al.

(10) Patent No.: US 10,543,708 B2
(45) Date of Patent: Jan. 28, 2020

(54) PRINTING PLATE FORMING METHOD AND CYLINDRICAL FORMING APPARATUS FOR PRINTING PLATE

(71) Applicant: SHOWA ALUMINUM CAN CORPORATION, Tokyo (JP)

(72) Inventors: Hitoshi Tojima, Tokyo (JP); Tomohiro Oku, Tokyo (JP)

(73) Assignee: SHOWA ALUMINUM CAN CORPORATION, Tokyo (JP)

( * ) Notice: Subject to any disclaimer, the term of this patent is extended or adjusted under 35 U.S.C. 154(b) by 51 days.

(21) Appl. No.: 15/515,700

(22) PCT Filed: Sep. 28, 2015

(86) PCT No.: PCT/JP2015/077263

§ 371 (c)(1),
(2) Date: Mar. 30, 2017

(87) PCT Pub. No.: WO2016/072171

PCT Pub. Date: May 12, 2016

(65) Prior Publication Data

US 2017/0305180 A1 Oct. 26, 2017

(30) Foreign Application Priority Data

Nov. 4, 2014 (JP) ..... 2014-224282

(51) Int. Cl.
*B41N 1/22* (2006.01)
*B41C 1/04* (2006.01)
(Continued)

(52) U.S. Cl.
CPC ..... *B41N 1/22* (2013.01); *B41C 1/02* (2013.01); *B41C 1/04* (2013.01); *B41C 1/18* (2013.01);
(Continued)

(58) Field of Classification Search
CPC ..... B41N 1/22
(Continued)

(56) References Cited

U.S. PATENT DOCUMENTS 4,833,985 A * 5/1989 Kojima ..... G03F 9/00 101/401.1
4,875,960 A * 10/1989 Shinomiya ..... B29C 31/002 156/203
(Continued)

FOREIGN PATENT DOCUMENTS

EP 2 626 207 A1 8/2013
JP 2006-035560 A 2/2006
(Continued)

OTHER PUBLICATIONS

Supplemental European Search Report Corresponding to EP 15856639 dated May 29, 2018.
(Continued)

*Primary Examiner* — Anthony H Nguyen
(74) *Attorney, Agent, or Firm* — Millen, White, Zelano & Branigan, P.C.; William Nixon

(57) ABSTRACT

A cylindrical printing plate formed with high precision and used for printing on a metal can body, particularly an aluminum or aluminum alloy can body. The forming method of a printing plate forms the printing plate to be mounted on an outer periphery of a cylindrical plate cylinder, and includes a notch forming step of forming a positioning notch in a rectangular elastic material sheet in which a resin layer to be served as a plate section is formed on one surface. A cylindrical material forming step rolls the elastic material sheet in which the positioning notch is formed and overlaps both end portions of the elastic material sheet and joining them in a cylindrical shape. A plate section engraving step
(Continued)

engraves a printing pattern on the plate section of the elastic material sheet formed into a cylinder shape.

9 Claims, 7 Drawing Sheets

(51) Int. Cl.
*B41C 1/18* (2006.01)
*B41C 1/02* (2006.01)
*B41N 3/00* (2006.01)
*B41N 7/00* (2006.01)

(52) U.S. Cl.
CPC ..... *B41N 3/00* (2013.01); *B41N 7/005* (2013.01); *B41N 2207/14* (2013.01)

(58) Field of Classification Search
USPC ..... 101/395
See application file for complete search history.

(56) References Cited

U.S. PATENT DOCUMENTS 5,379,693 A * 1/1995 Hoffmann ..... B41F 27/005 101/216
6,016,752 A * 1/2000 Harari ..... B41B 21/34 101/401.1
7,398,732 B2 * 7/2008 Hebert ..... B41F 27/12 101/401.1
7,717,040 B2 * 5/2010 Shishkin ..... B41C 1/05 101/401.1
7,750,267 B2 * 7/2010 Van Denend ..... B23K 26/03 219/121.6
8,621,995 B2 * 1/2014 Claes ..... B41F 27/005 101/375
9,102,135 B2 * 8/2015 Minoshima ..... B41F 27/1218
2010/0319555 A1 * 12/2010 Hashimoto ..... B41F 13/10 101/36
2011/0120332 A1 * 5/2011 Izume ..... B41F 27/105 101/382.1
2011/0210111 A1 * 9/2011 Izume ..... B41F 27/02 219/153
2013/0074719 A1 * 3/2013 Hanafusa ..... B41C 1/05 101/401.1
2013/0263750 A1 10/2013 Minoshima et al.

FOREIGN PATENT DOCUMENTS

JP 2010-162878 A 7/2010
JP 2010-162879 A 7/2010
JP 2010-253794 A 11/2010
JP 2011-025543 A 2/2011
JP 2012-254623 A 12/2012
JP 2013-000753 A 1/2013
JP 2013-159066 A 8/2013
JP 2014-515322 A 6/2014

OTHER PUBLICATIONS

International Search Report dated Dec. 15, 2015 issued in corresponding PCT/JP2015/077263 application (2 pages).
Machine Translation of JP 2014-515322 A published Jun. 30, 2014.
English Abstract of JP 2006-035560 A published Feb. 9, 2006.
English Abstract of JP 2010-162879 A published Jul. 29, 2010.
English Abstract of JP 2010-253794 A published Nov. 11, 2010.
English Abstract of JP 2013-000753 A published Jan. 7, 2013.
English Abstract of JP 2013-159066 A published Aug. 19, 2013.

* cited by examiner

PRINTING PLATE FORMING METHOD AND CYLINDRICAL FORMING APPARATUS FOR PRINTING PLATE

TECHNICAL FIELD

The present invention relates to a method of forming a printing plate used to print on a metal can body, particularly used to print on an aluminum or aluminum alloy can body.

BACKGROUND ART

Conventionally, it is known to print on a metal can body using a printing plate having an image pattern attached to a plate cylinder of a printing apparatus.

Patent Document 1 discloses a cylindrical member manufacturing apparatus equipped with a cylinder member having a groove formed on the outer periphery of the cylinder member, and configured to form a plate-shaped base member into a cylindrical printing plate by winding the base member on the cylinder member while rotating the cylinder member in a state in which bent portions of the base member formed by bending the end portions of the base member in the thickness direction are engaged with the groove of the cylinder member.

PRIOR ART

Patent Document

Patent Document 1: Japanese Unexamined Patent Application Publication No. 2013-159066

SUMMARY OF THE INVENTION

Problems to be Solved by the Invention

However, in the apparatus as disclosed in Patent Document 1, it was difficult to form a high precision cylindrical printing plate not causing an individual difference due to, e.g., a misalignment of the plate section during the forming process by winding a base material having no bent portion at the end portion thereof on the cylinder member.

Means for Solving the Problems

In view of the aforementioned technical backgrounds, the present invention aims to provide a method of forming a cylindrical printing plate with high precision for use in printing on a metal can body, particularly for use in printing an aluminum or aluminum alloy can body.

That is, the present invention has the following configurations as recited in the following Items [1] to [8].

[1] A method of forming a printing plate to be mounted on an outer periphery of a cylindrical plate cylinder, comprising:

a notch forming step of forming a positioning notch in a rectangular elastic material sheet having a resin layer serving as a plate section formed on one surface of the elastic material sheet;

a cylindrical material forming step of rolling the elastic material sheet in which the positioning notch is formed and joining both end portions of the elastic material sheet in an overlapped state to form a cylindrical shape; and a plate section engraving step of engraving a printing pattern at the plate section of the elastic material sheet formed into a cylinder shape.

[2] The method of forming a printing plate as recited in the aforementioned Item [1], wherein the positioning notch is provided at a position other than a joint portion in which both the end portions of the elastic material sheet are joined in an overlapped manner.

[3] The method of forming a printing plate as recited in the aforementioned Item [1] or [2], wherein the cylindrical material forming step includes:

first processing of rounding the elastic material sheet to plastically deform until a predetermined processing degree is reached; and second processing of further rounding the elastic material sheet to overlap both end portions of the elastic material sheet into a cylindrical shape.

[4] The method of forming a printing plate as recited in the aforementioned Item [3], wherein in the first processing, the elastic material sheet is plastically deformed until a diameter of the elastic material sheet formed into a cylindrical shape becomes about 1.2 times or more and about 3 times or less a diameter of the elastic material sheet formed by the first processing.

[5] The method of forming a printing plate as recited in the aforementioned Item [3] or [4], wherein the first processing is performed such that a processing degree is set to be different between one end portion side and the other end portion side of the elastic material sheet.

[6] The method of forming a printing plate as recited in any one of the aforementioned Items [1] to [5], wherein at both side portions of a joint portion where both end portions of the cylindrically shaped elastic material sheet are overlapped and joined, bent portions are provided at a distance approximately equal to a width dimension of a flat portion formed by removing a part of an outer periphery of the plate cylinder, and wherein the printing plate and the plate cylinder are positioned by the bent portions and the flat portion.

[7] The method of forming a printing plate as recited in the aforementioned Item [6], wherein the positioning notch is provided at a portion other than a portion between the bent portions including the joint portion.

[8] An apparatus for forming a cylindrical printing plate, comprising:

a cylinder member including a positioning protrusion to be engaged with a positioning notch formed in a rectangular elastic material sheet, and a flat portion formed by removing a part of a cylindrically formed circumference;

fixing means for pressing down a vicinity of the positioning notch of the elastic material sheet to fix to a circumference of the cylinder member in a state in which the positioning notch of the elastic material sheet and the positioning protrusion are engaged with each other;

roller means for forming the elastic material sheet into a cylindrical shape with rollers provided on left and right sides of the cylinder member as seen in an axial direction of the cylinder member;

pressing means for pressing both end portions of the elastic material sheet in an overlapped manner at a position of the flat portion; and joining means for joining both the end portions of the elastic material sheet in a state in which the elastic material sheet is pressed by the pressing means.

Effects of the Invention

According to the invention as recited in the aforementioned Item [1], a forming method of a printing plate to be mounted on an outer periphery of a cylindrical plate cylinder includes a notch forming step of forming a positioning notch in a rectangular elastic material sheet having a resin layer serving as a plate section formed on one surface of the elastic material sheet, a cylindrical material forming step of rolling the elastic material sheet in which the positioning notch is formed and joining both end portions of the elastic material sheet in an overlapped state so as to form a cylindrical shape, and a plate section engraving step of engraving a printing pattern on the plate section of the elastic material sheet formed into a cylinder shape. Therefore, by forming a positioning notch in advance in the elastic material sheet, even when forming a printing plate by winding the elastic material sheet on a cylinder member or the like, the elastic material sheet can be positioned in the circumferential direction with respect to the cylinder member or the like. Therefore, it is possible to easily shape the elastic material sheet into a cylindrical printing plate excellent in shape accuracy. As a result, a printing plate improved in printing accuracy can be obtained.

Further, the positioning notch can be formed more easily than forming a positioning notch in a cylindrically formed printing plate.

According to the invention as recited in the aforementioned Item [2], since the positioning notch is provided at a position other than a joint portion in which both the end portions of the elastic material sheet are joined in an overlapped manner, the positioning notch formed in advance does not interfere with joining of the joint portion.

According to the invention as recited in the aforementioned Item [3], the cylindrical material forming step includes first processing of rounding the elastic material sheet to plastically deform until a predetermined processing degree is reached, and second processing of further rounding the elastic material sheet to overlap both end portions of the elastic material sheet into a cylindrical shape. Therefore, by performing the second processing after plastically deforming the elastic material sheet in advance so that the elastic material sheet becomes rounded by the first processing, the repulsive force causing restoration of the elastic material sheet is reduced.

As a result, in both the overlapped end portions of the elastic material sheet, a strong joining force obtained by, for example, joining with adhesive and welding is not required, and the joining can be performed only by, for example, welding, which simplifies the joining operation.

By forming the elastic material sheet stepwise into a cylindrical shape by the first processing and the second processing, it is possible to form the printing plate into a cylindrical shape with high accuracy.

According to the invention as recited in the aforementioned Item [4], in the first processing, the elastic material sheet is plastically deformed until a diameter of the elastic material sheet formed into a cylindrical shape becomes about 1.2 times or more and about 3 times or less a diameter of the elastic material sheet formed by the first processing. Therefore, in the first processing, since the printing plate is processed within a suitable range, the second processing to be performed thereafter can be performed easily.

According to the invention as recited in the aforementioned Item [5], the first processing is performed such that a processing degree is set to be different between one end portion side and the other end portion side of the elastic material sheet. The end portion larger in processing degree enters the inside of the small end portion smaller in processing degree and overlaps. Therefore, the subsequent joining steps can be performed easily.

According to the invention as recited in the aforementioned Item [6], in both side portions of a joint portion where both end portions of the cylindrically shaped elastic material sheet are overlapped and joined, bent portions are provided at a distance approximately equal to a width dimension of a flat portion formed by removing a part of an outer periphery of the plate cylinder, and the printing plate and the plate cylinder are positioned by the bent portion and the flat portion. Therefore, the joint portion of the printing plate is hard to be bent since both end portions of the elastic material sheet are overlapped, and the bent portion is formed to have a curvature lower than that of the other parts. Therefore, when mounting the printing plate on the outer periphery of the plate cylinder, it becomes easier to align and guide the bent portion of the printing plate and the flat portion of the plate cylinder, making the mounting of the printing plate more accurate and easy.

According to the invention as recited in the aforementioned Item [7], the positioning notch is provided at a portion other than a portion between the bent portions including the joint portion. Therefore, by providing the positioning notch at the part set almost equal to the curvature of the plate cylinder, when mounting the printing plate on the plate cylinder, it is easy to engage with the part of the plate cylinder to be engaged with the positioning notch.

According to the invention as recited in the aforementioned Item [8], the apparatus includes a cylinder member including a positioning protrusion to be engaged with a positioning notch formed in a rectangular elastic material sheet, and a flat portion formed by removing a part of a cylindrically formed circumference, fixing means for pressing down a vicinity of the positioning notch of the elastic material sheet to fix to an outer periphery of the cylinder member in a state in which the positioning notch of the elastic material sheet and the positioning protrusion are engaged with each other, roller means for forming the elastic material sheet into a cylindrical shape with rollers provided on left and right sides of the cylinder member as seen in an axial direction of the cylinder member, pressing means for pressing both end portions of the elastic material sheet in an overlapped manner at a position of the flat portion, and joining means for joining both the end portions of the elastic material sheet in a state in which the elastic material sheet is pressed by the pressing means. Therefore, the elastic material sheet can be positioned in the circumferential direction with respect to the cylinder member by the positioning notch and the elastic material sheet can be fixed by the fixing means. The elastic material sheet will not shift in the circumferential direction even during the processing work by means of the roller means, the pressing means, and the joining means, it is excellent in shape accuracy and is possible to form the elastic material sheet into a cylindrical shape.

Further, after forming the elastic material sheet into a cylindrical shape, a print pattern is engraved using a plate cylinder having the same shape as the cylinder member of the cylindrical forming apparatus, and printing is performed using the same cylinder having the same shape. Therefore, the image positioning accuracy is high, registering becomes unnecessary, and a printing plate with improved printing accuracy can be formed.

EMBODIMENTS FOR CARRYING OUT THE INVENTION

Hereinafter, embodiments of the present invention will be described with reference to the drawings.

Figure 1:
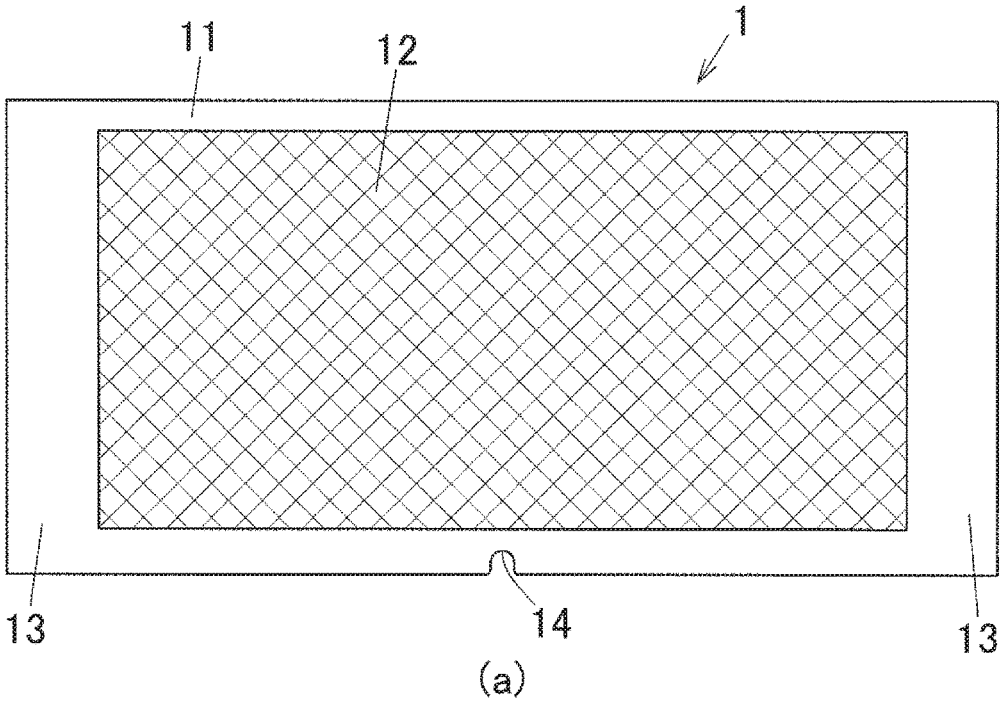
FIG. 1 is an explanatory view for explaining a printing plate according to the present invention.
Figure 1:
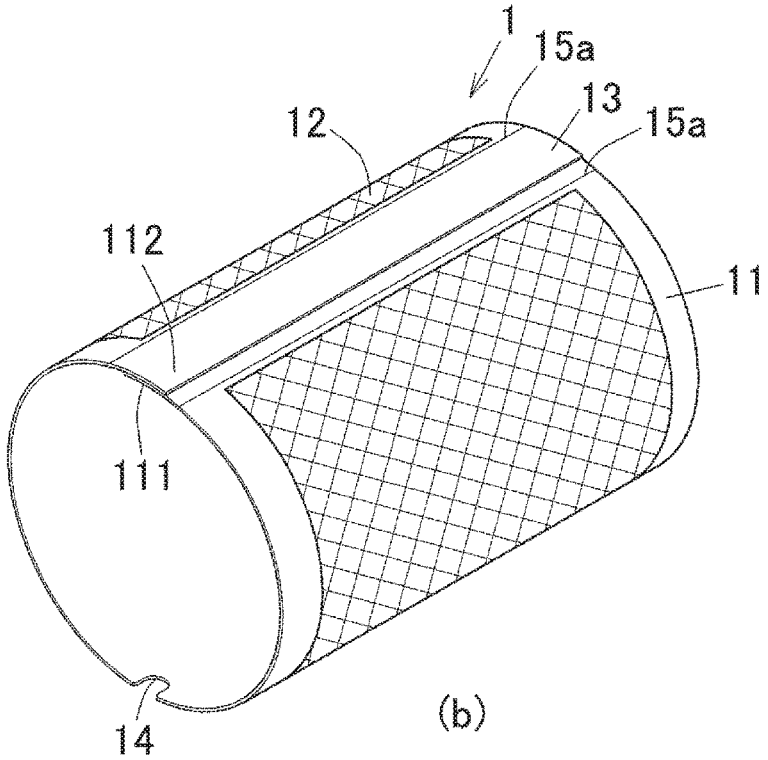
Figure 2:
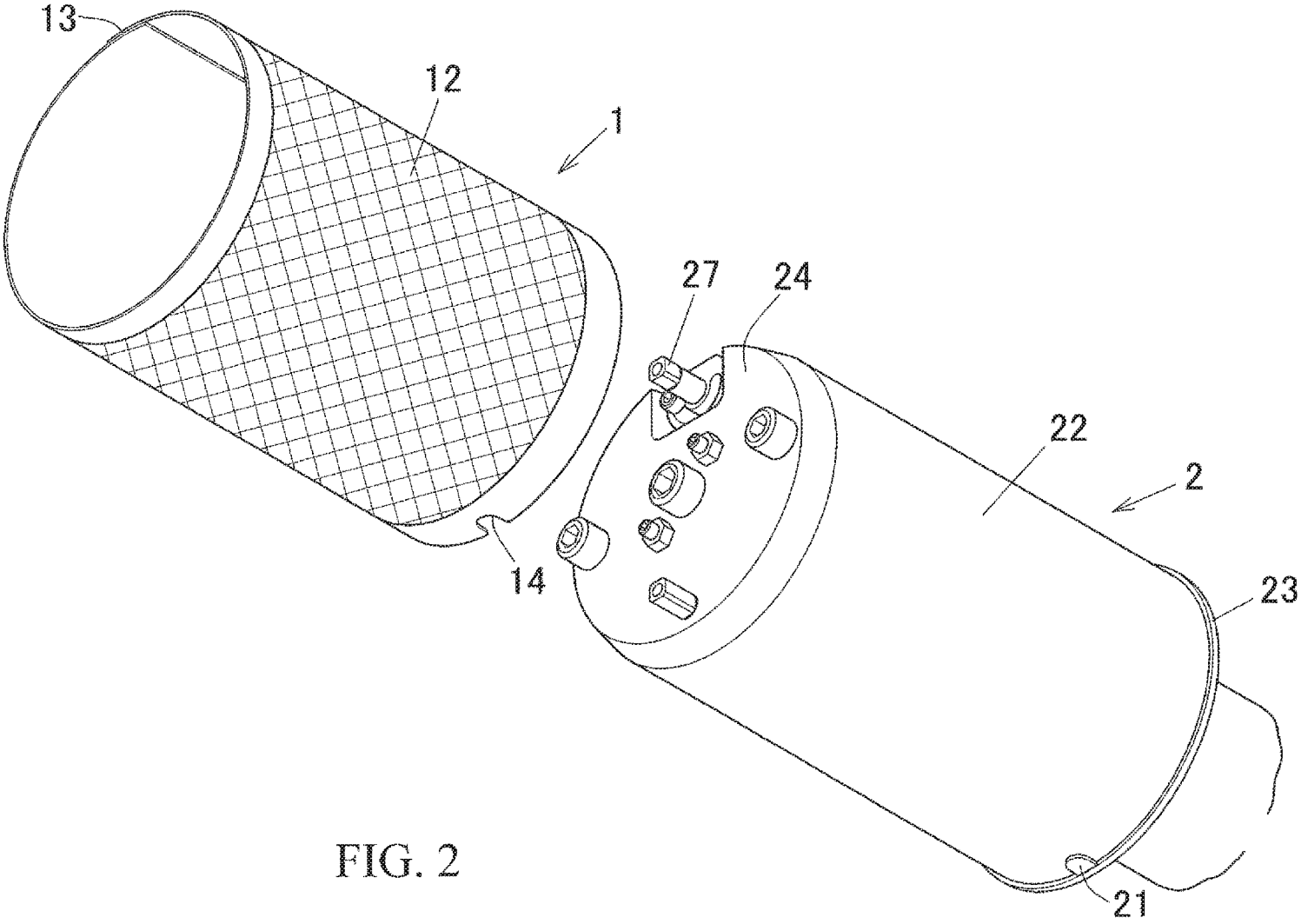
FIG. 2 is an explanatory view for explaining mounting of the printing plate on a plate cylinder according to the present invention.
Figure 3:
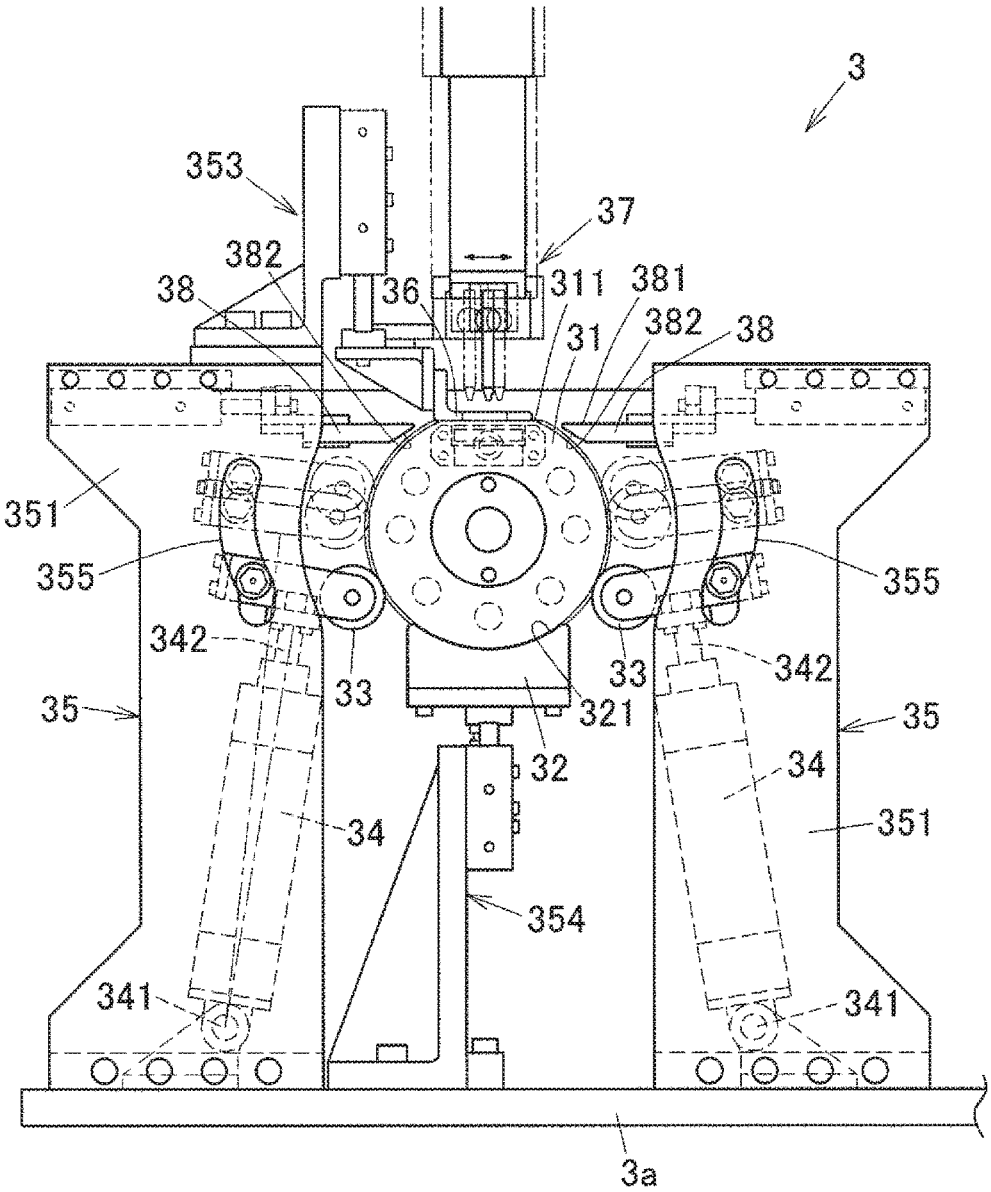
FIG. 3 is a front view of a cylindrically forming apparatus for forming the printing plate into a cylindrical shape according to the present invention.
Figure 4:
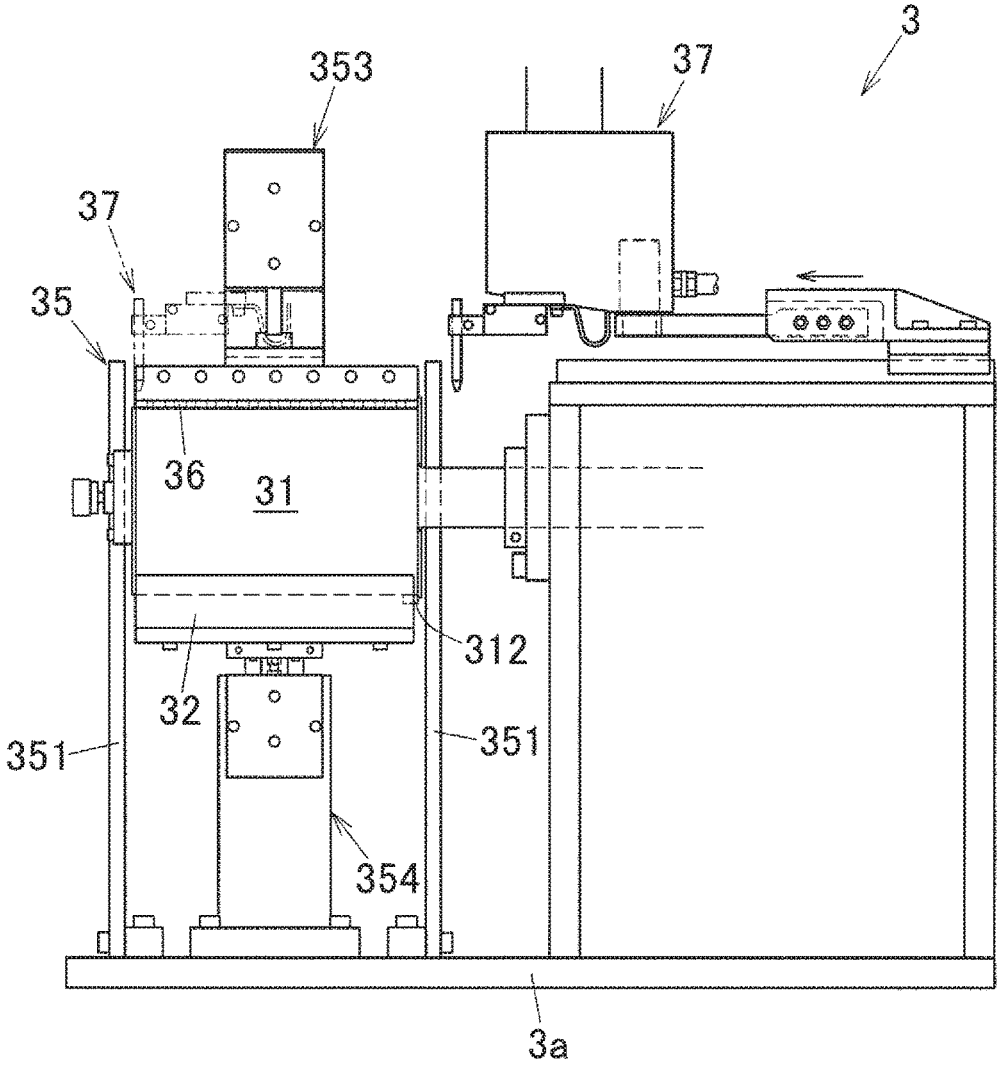
FIG. 4 is aside view of the cylindrically forming apparatus for forming the printing plate into the cylindrical shape according to the present invention.
Figure 5:
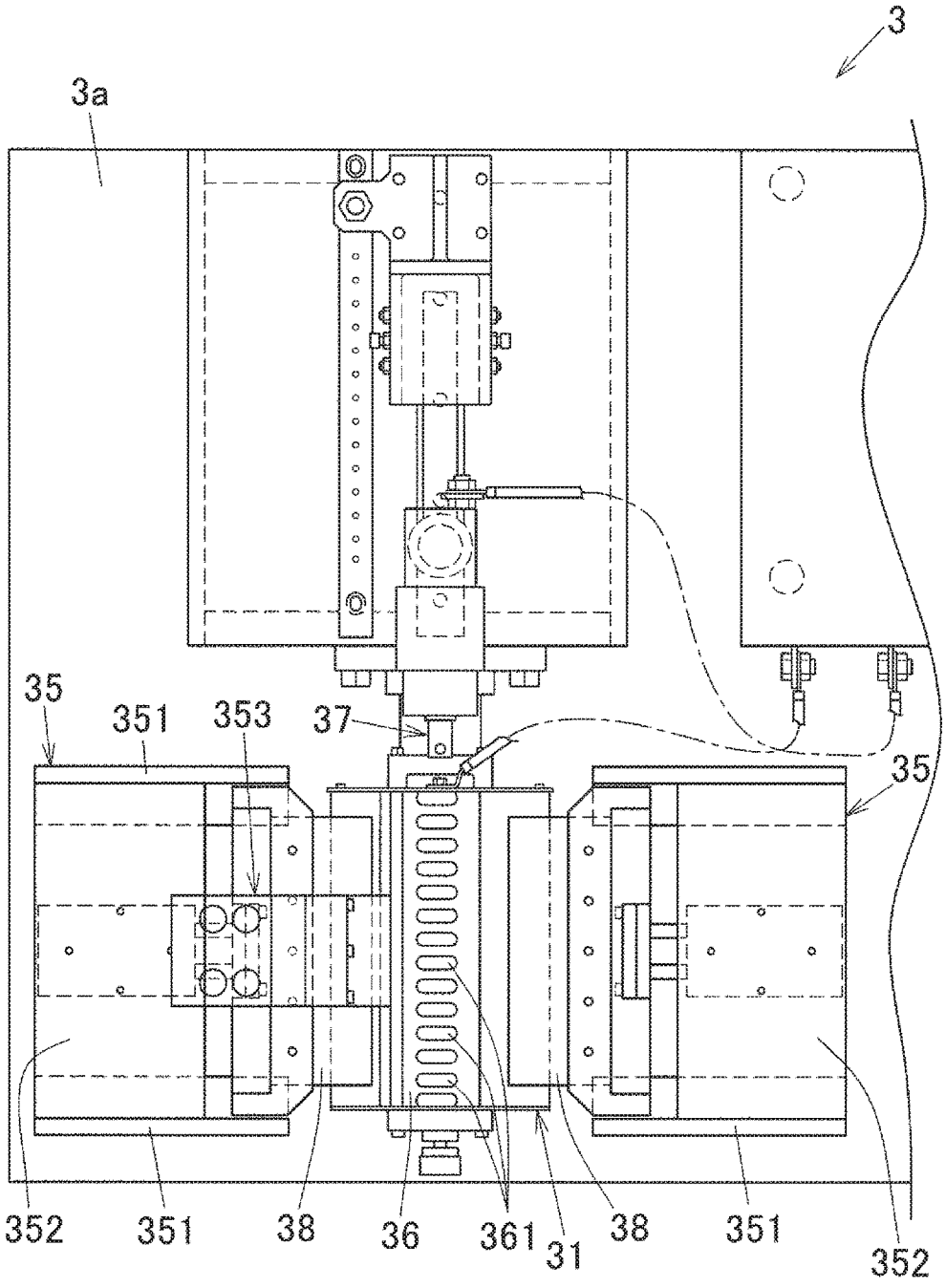
FIG. 5 is a plan view of the cylindrically forming apparatus for forming the printing plate into the cylindrical shape according to the present invention.
Figure 6:
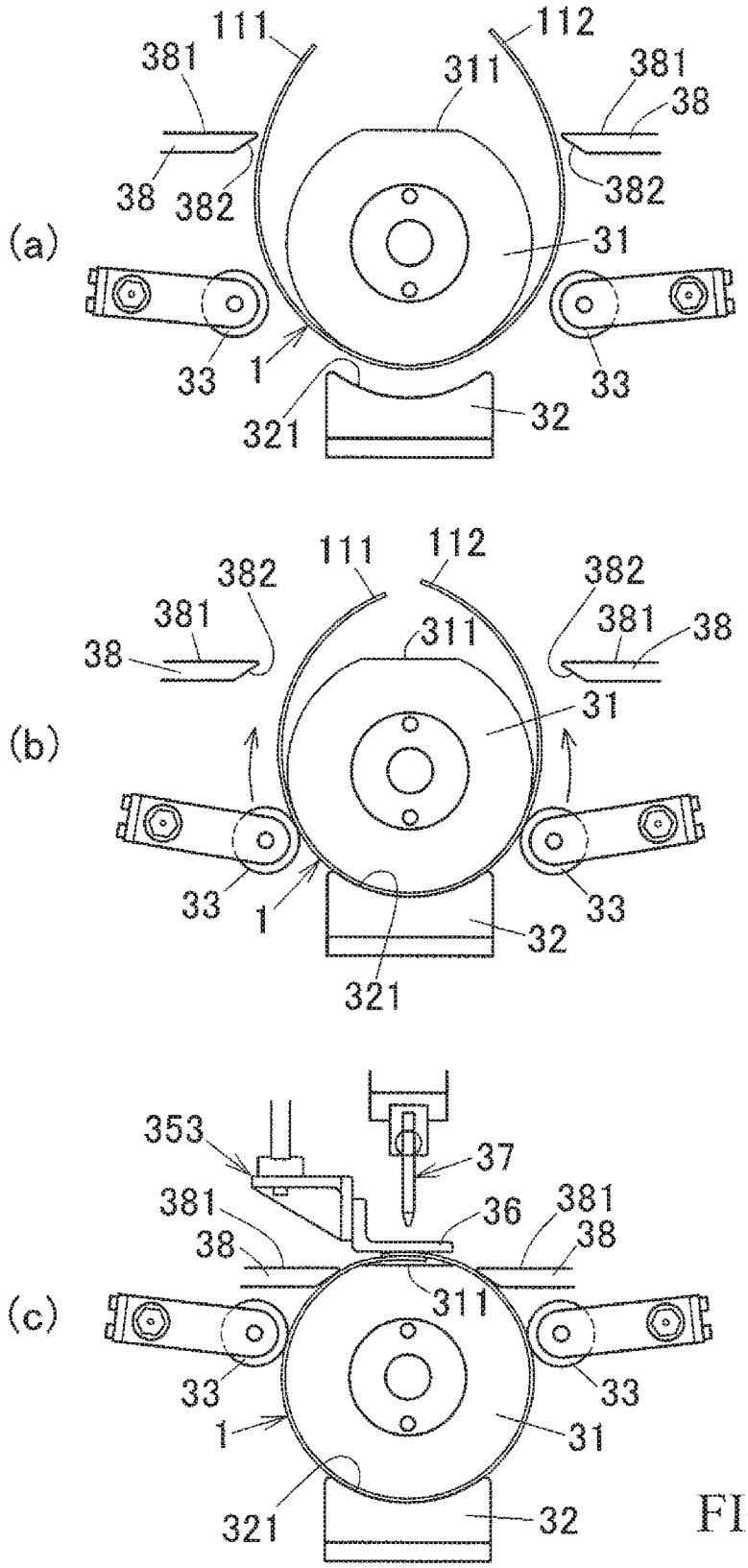
FIG. 6 is an explanatory view for explaining a forming method of a printing plate according to the present invention.
Figure 7:
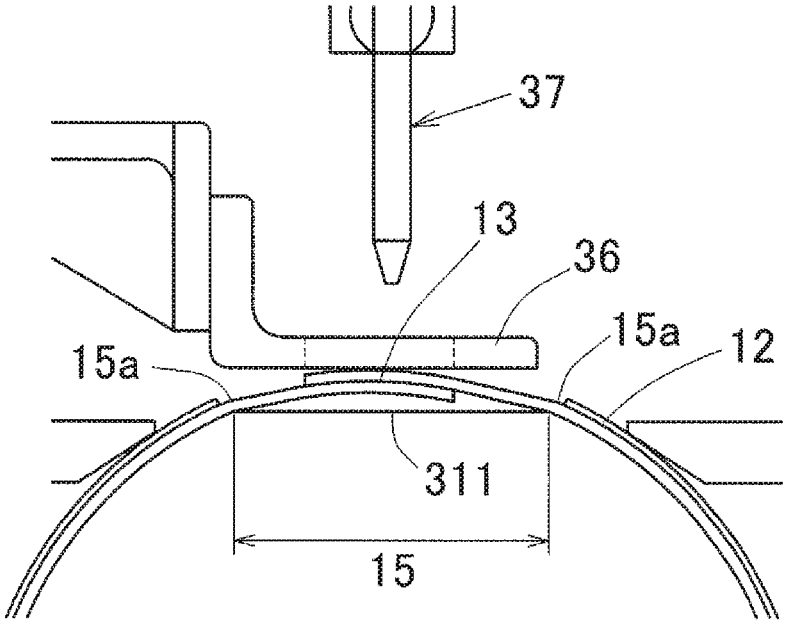
FIG. 7 is an enlarged view for explaining a curved portion of a printing plate according to the present invention.

FIG. 1 is an explanatory view for explaining a printing plate 1. FIG. 2 is an explanatory view for explaining mounting of the printing plate 1 on a plate cylinder 2. FIG. 3 is a front view of a cylindrically forming apparatus for forming the printing plate 1 into a cylindrical shape. FIG. 4 is a side view of the cylindrically forming apparatus for forming the printing plate into a cylindrical shape. FIG. 5 is a plan view of the cylindrically forming apparatus for forming the printing plate 1 into a cylindrical shape. FIG. 6 is an explanatory view for explaining a forming method of the printing plate 1. FIG. 7 is an enlarged view for explaining a curved portion 15 of the printing plate 1.

In the following description, the upper and lower sides of the plate cylinder 2 shown in FIG. 2 will be referred to as upper and lower sides, the left side will be referred to as the front side or the front end, the right side will be referred to as the rear side or the rear end, and the explanation will be made by defining left and right sides as left and right side as viewed from the front side.

First, with reference to FIGS. 1 to 7, the following description will be directed to a plate mounting apparatus for printing on a metal can body having a plate cylinder 2 on which a cylindrical printing plate 1 is mounted.

The plate mounting apparatus is an apparatus commonly equipped to a printing machine for printing on a printing object and an engraving machine for engraving a print pattern on a printing plate 1 for use in a printing machine.

As the printing plate 1 to be mounted on the plate cylinder 2, a printing plate 1 formed into a cylindrical shape, in particular a printing plate 1 having a small diameter, is used.

The printing material, which is subjected to printing, is a beverage metal can body, in particular, a bottomed cylindrical beverage metal can body formed by subjecting an aluminum or aluminum alloy plate to draw & ironing (DI) forming.

The plate mounting apparatus is equipped with a plate driving shaft, which is not illustrated, provided so as to protrude forward from the machine frame of the printing machine and a plate cylinder 2 fitted to the plate driving shaft from the tip end portion side thereof and fixed to the outer peripheral surface of the plate driving shaft.

The plate driving shaft is rotatably supported by the machine frame at a basal end portion side of the plate driving shaft, and rotated by a known driving means at a predetermined speed in a predetermined direction.

The plate cylinder 2 is formed into a cylindrical shape, and is provided with, at the center thereof, an insertion hole through which the plate driving shaft is inserted.

On the outer periphery of the plate cylinder 2, a cylindrical plate mounting surface 22 is formed concentric with the plate driving shaft. To the plate mounting surface 22, a printing plate 1 formed in a cylindrical shape, especially a small diameter printing plate 1, is detachably attached.

The plate cylinder 2 is a hollow member formed by removing the inner portion to reduce the weight, and is provided with a cylindrical portion having a plate mounting surface 22 on an outer periphery thereof, and a lid portion 24 covering the front face of the plate cylinder 2.

The plate cylinder 2 is fixed to the plate driving shaft with the plate driving shaft fitted in the insertion hole, and rotates together with the plate driving shaft.

In the plate mounting surface 22, in order to secure a fixing force by a frictional resistance with respect to the inner surface of the printing plate 1 mounted, it is preferable that the surface roughness be about Ra 1 μm or less to keep the static friction.

Considering that the surface roughness is kept small and the surface is less likely to be scratched, it is preferable that the plate mounting surface 22 be coated (plated) with a hard chromium coat.

The plate cylinder 2 is provided with a plate fixing member mounting surface which is a flat surface formed by removing a part of the cylindrical portion, and a part of the outer periphery of the cylindrical portion excluding the plate fixing member mounting surface is served as a plate mounting surface 22 on which the printing plate 1 is mounted.

The plate fixing member mounting surface is positioned radially inward of a cylindrical surface including the plate mounting surface 22, and is provided with a plate mounting member for fixing the printing plate 1 so as to be movable radially inward and outward on the outer peripheral surface of the plate cylinder 2.

The outer diameter of the plate mounting surface 22 and the inner diameter of the printing plate 1 are set to be substantially equal in size.

The plate fixing member is formed, for example, into a rectangular shape elongated in the axial direction of the plate cylinder 2, and is configured such that the radially outward end face of the plate fixing member abuts against the inner peripheral surface of the printing plate 1 by moving the plate mounting member radially outward of the plate cylinder 2.

Since the plate cylinder 2 has a plate fixing member mounting surface, the total circumferential length of the plate mounting surface 22 and the plate fixing member mounting surface is shorter than the circumferential length of a cylindrical surface formed by the plate mounting surface 22 of the plate cylinder 2.

The circumferential length of the inner peripheral surface of the printing plate 1 is set to be slightly larger than the total circumferential length of the plate mounting surface 22 of the plate cylinder 2 and the plate fixing member mounting surface, and slightly smaller than the circumferential length of a cylindrical surface formed by the plate mounting surface 22 of the plate cylinder 2.

This makes it easy to insert the printing plate 1 onto the plate cylinder 2, and also makes it possible to avoid a situation in which the portion pushed by the plate fixing member protrudes radially outward than the other portion of the printing plate 1.

On the plate fixing member mounting surface, a rectangular groove elongated in the axial direction is formed over a larger part of the plate cylinder 2 in the axial length.

The groove is rectangular in cross-sectional shape, and both the side walls and the bottom wall are each formed into a flat surface, and a plate fixing member is fitted in the groove movably in the radial direction of the plate cylinder 2.

The outer diameter of the plate mounting surface 22 and the inner diameter of the printing plate 1 are set to be substantially equal in size.

The plate fixing member is configured to expand apart of the printing plate 1 mounted on the plate cylinder 2 by pushing it radially outward from the radially inner side within the range of the inner side of a cylindrical surface formed by the outer surface of the printing plate 1 including the plate section 12.

The plate fixing member is provided with a rotary shaft extending in the axial direction of the plate cylinder 2, and is configured to be movable in the radial direction of the plate cylinder 2 inside the plate cylinder 2 in accordance with the rotation of the rotary shaft configured to be rotatable in the plate fixing member.

An end stopper 23 for determining the mounting position of the printing plate 1 in the axial direction is fixed to the outer peripheral portion of the rear end face of the cylindrical portion of the plate cylinder 2.

The end stopper 23 is formed into an annular shape protruding slightly radially outward from the plate mounting surface 22, and is configured so that the rear end portion of the printing plate 1 comes into contact with the annular surface when the printing plate 1 is fitted to the plate cylinder 2 from the tip end side thereof.

Since the end stopper 23 is provided, the rear end portion of the printing plate 1 can be accurately and easily attached to a predetermined position of the plate cylinder 2.

On the lower side of the plate cylinder 2 and on the front side of the end stopper 23, a positioning stepped portion 21 for positioning the printing plate 1 at least in the circumferential direction is provided.

The positioning stepped portion 21 slightly protrudes, for example, radially outwardly of the plate cylinder 2, and is formed as a stepped portion having a substantially semicircular shape in plan view.

The printing plate 1 is provided with a plate body 11 formed of an elastic material in a cylindrical shape and a plate section 12 formed in a part of the outer peripheral portion of the plate body 11.

It should be noted that the plate section 12 is used to mean both of a section after the print pattern is engraved and a section before the print pattern is engraved.

The plate body 11 is rolled into a cylindrical shape and overlapped both end portions thereof 111 and 112 are joined. Thus, a printing plate 1 is formed.

The joint portion 13 formed by joining both end portions 111 and 112 of the plate body 11 becomes difficult to maintain the strength of the joint when the width dimension is too small, whereas the material cost increases when the width dimension is too large. Therefore, both the end portions are overlapped and joined at least with a width dimension that can maintain the strength of the joining.

As the joining method of the joint portion 13, the most preferable joining method is welding, but not specifically limited it as long as a joining method to be adapted is capable of preventing both the end portions 111 and 112 of the elastic material sheet from being easily detached.

The plate body 11 has a curved portion 15 formed with a curvature lower than the curvature of the other portion of the cylindrically shaped printing plate 1 (the portion that comes into contact with the plate mounting surface 22 of the plate cylinder 2).

The curved portion 15 includes the joint portion 13 and its vicinities, specifically, both side portions of the joint portion 13.

At the boundary between the curved portion 15 and the other portion, a bent portion 15*a* having a slight curvature due to the difference in curvature on both sides of the boundary portion is formed. The curved portion 15 is defined as an area between the bent portions 15*a* provided at both side portions of the joint portion 13.

It is preferable that the curved portion 15 be set to have a width substantially equal to the width of the flat portion formed by removing a part of the outer periphery of the plate cylinder 2.

With such a configuration, it is possible to mount the printing plate 1 on the plate cylinder 2 while aligning the bent portions 15*a* of the printing plate 1 and the end portions of the flat portion of the plate cylinder 2.

At both side portions of the joint portion 13 in which both the end portions 111 and 112 of the cylindrically shaped elastic material sheet are overlapped and joined, the bent portions 15*a* are provided at a distance substantially equal to the width dimension of the flat portion formed by removing a part of the outer periphery of the plate cylinder 2. When the printing plate 1 and the plate cylinder 2 are positioned by the bent portions 15*a* of the elastic material sheet (printing plate 1) and the flat portion of the plate cylinder 2, the joint portion 13 of the printing plate 1 is hard to be bent since both the end portions of the elastic material sheet are overlapped. Further, the bent portion 15*a* is formed to have a curvature lower than the curvature of the other portion (the portion contacting the plate mounting surface 22 of the plate cylinder 2). Therefore, when mounting the printing plate 1 on the outer periphery of the plate cylinder 2, it becomes easier to align the bent portion 15*a* of the printing plate 1 and the flat portion of the plate cylinder 2 and guide them, which makes the mounting of the printing plate 1 more accurate and easy.

The plate section 12 is provided at a predetermined position on the outer peripheral surface of the plate body 11 except for the curved portion 15, and is formed on the outer surface portion of the plate body 11 which comes into close contact with the plate mounting surface 22 when the printing plate 1 is mounted on the plate cylinder 2.

The elastic material sheet is made of a rectangular elastic material sheet made of suitable magnetic or nonmagnetic metal, for example, a commercially available tin plate (Fe). The thickness of the sheet may be a thickness capable of forming the sheet into a cylindrical shape and holding the cylindrical shape by elastic force. In this example, the thickness is about 0.26 mm.

In the plate body 11, a resin layer to be served as the plate section 12 is formed on one surface of the plate body 11. For this resin layer, for example, a resin, such as, e.g., a polyvinyl alcohol based resin, a vinyl ester based resin, and a polyamide based resin, may be adopted, and for example, those having a Shore D hardness of about D20 to 80 after curing are suitably adapted.

For example, when a UV curing resin (ultraviolet curing resin) for ordinary offset printing is used, no complicated washing work using a solvent or high-pressure steam required for curing resins other than the above is required, and in general, the washing can be performed with water.

The thickness of the resin layer may be any thickness required for the plate section 12 of printing. In this example, a 0.4 to 0.6 mm thick layer is adhered to one surface of the elastic material sheet.

The cylindrical printing plate 1 is fitted from the tip end side of the plate cylinder 2 and mounted on the plate mounting surface 22 which is an outer peripheral surface of the plate cylinder 2.

In the printing plate 1, a positioning notch 14 is formed at a longitudinal one end portion, more specifically, the end portion serving as a rear end side when mounted on the plate mounting surface 22 of the plate cylinder 2.

The positioning notch 14 is configured to be engaged with the positioning stepped portion 21 of the plate cylinder 2, and extends in the axial direction of the printing plate 1. The positioning notch 14 has an arc portion with a curvature matching the outer peripheral shape of the circumferentially positioning stepped portion 21 at its inner end portion.

The positioning notch 14 is configured to position the printing plate 1 in the circumferential direction of the printing plate 1 and in the axial direction of the plate cylinder 2 with the end portion of the positioning notch 14 abut against the outer peripheral surface of the positioning stepped portion 21 when the printing plate 1 is mounted on the plate cylinder 2 fully to the rear end side thereof.

The positioning notch 14 is provided at a portion other than the joint portion 13 in which both the end portions 111 and 112 of the elastic material sheet are joined, and therefore the positioning notch 14 formed in advance does not interfere with joining of the joint portion 13.

Further, when the positioning notch 14 is provided at a portion other than the portion between the bent portions 15*a* including the joint portion 13, that is, the positioning notch 14 is provided at a portion contacting the plate mounting surface 22 of the plate cylinder 2, the positioning notch 14 is arranged at a portion set to have a curvature substantially equal to the curvature of the plate cylinder 2. Therefore, when mounting the printing plate 1 on the plate cylinder 2, the printing plate 1 can be easily engaged with a portion (for example, positioning stepped portion 21) of the plate cylinder 2 to be engaged with the positioning notch 14.

The elastic material sheet is formed into a cylindrical printing plate through two stages of processing, for example, first processing and second processing.

An elastic material sheet cut into a size necessary to form the cylindrical printing plate 1 is subjected to a roll press machine to thereby perform first processing.

The elastic material sheet is pressed by being sandwiched and pressed between a pair of rolls provided on a roll press machine to thereby be rounded.

In the first processing, the elastic material sheet is plastically deformed at a predetermined processing degree, for example, until a diameter of the elastic material sheet after forming into a cylindrical shape becomes about 1.2 times or more and about 3 times or less a diameter of the elastic material sheet formed by the first processing.

Specifically describing, when the inner diameter of the printing plate 1 after joining is 125.45 mm to 125.50 mm, the first processing is performed so that the inner diameter of the elastic material sheet falls within the range of about 1.2 times to about 3 times the inner diameter of the printing plate 1 after joining, or within the range of about 150 mm to 370 mm.

The predetermined processing degree in the first processing is preferably set to fall within the range of about 1.2 times to about 2.8 times (150 mm to 350 mm) of the inner diameter of the printing plate 1, more preferably about 1.4 times to 2.5 times (180 mm to 310 mm) the inner diameter of the printing plate 1.

In the first processing, the elastic material sheet is plastically deformed until the diameter of the elastic material sheet formed into a cylindrical shape is about 1.2 times or more and about 3 times or less the diameter of the elastic material sheet formed by the first processing. Thus, in the first processing, the printing plate 1 is processed within a preferable range, which facilitates the second processing to be performed thereafter.

Further, in the first processing, both end portions 111 and 112 of the elastic material sheet are bent so as to have different processing degrees, that is, different curvatures.

It is not preferable that the processing degree of both end portions 111 and 112 is such that the ratio of the inner diameters of the end portions 111 and 112 of the elastic material sheet (i.e., the inner larger diameter/the inner smaller diameter) is too low (e.g., close to 1) since both the end portions 111 and 112 will not be overlapped naturally and therefore both the end portions 111 and 112 are required to be overlapped by a worker using a pressing means.

On the other hand, when the ratio of the processing degree is too high, the processing degree of only one end portion becomes too high, which may cause distortions, which is not preferable.

Therefore, the ratio of the processing degrees of both the end portions 111 and 112 is set to fall within the range of about 1.1 times to about 2 times, preferably within the range of about 1.3 times to about 1.7 times.

In the first processing, the processing degree is set to be different between the one end portion 111 side and the other end portion 112 side of the elastic material sheet. As a result, the end portion larger in processing degree (small in inner diameter) enters the inside of the end portion smaller in processing degree (larger in inner diameter) and both the end portions overlap, which facilitates the joining process to be performed later.

In the second processing to be performed after the first processing, the elastic material sheet is formed into a perfect cylindrical shape, and the overlapped end portions 111 and 112 are joined to form the joint portion 13 to thereby form a cylindrical printing plate 1.

For example, the elastic material sheet rounded in the first processing is formed into a cylindrical printing plate 1 by the cylindrically forming apparatus 3.

The inner diameter of the printing plate 1 is set to have a dimension substantially equal to the outer diameter of the plate mounting surface 22 by the second processing.

Hereinafter, with reference to FIGS. 3 to 5, a cylindrically forming apparatus 3 for forming the printing plate 1 into a cylindrical shape will be described.

The cylindrically forming apparatus 3 is provided with a base 3*a*, a cylinder member 31 on which a rectangular elastic material sheet is wound, a fixing means for fixing the elastic material sheet wound on the cylinder member 31 to the cylinder member 31 by pressing the elastic material sheet, and a roller means for processing the elastic material sheet into a cylindrical shape.

The cylinder member 31 is formed in a cylindrical shape and has a flat portion 311 in which apart of the cylindrical outer periphery is removed.

On the opposite side of the flat portion 311 of the cylinder member 31, a positioning protrusion 312 with which a positioning notch 14 formed in an elastic material sheet is engaged is formed.

That is, the positioning protrusion 312 of the cylinder member 31 performs the same function as the positioning stepped portion 21 of the plate cylinder 2.

The elastic material sheet is aligned with the cylinder member 31 by engaging the positioning notch 14 with the positioning protrusion 312, and then wound on the cylinder member 31 to be formed into a cylindrical shape.

The cylinder member 31 has a positioning protrusion 312 with which the positioning notch 14 of the elastic material sheet is engaged. Therefore, the elastic material sheet can be positioned on the cylinder member 31, and the elastic material sheet is not displaced in the circumferential direction during the working operation. Thus, it is possible to form the printing plate 1 with precise processing.

The fixing means is provided with a fixing member 32 which fixes the elastic material sheet to the cylinder member 31 by pressing the elastic material sheet.

The fixing member 32 is provided at a lower frame 354 arranged below the cylinder member 31, and is configured, for example, to move up and down so as to be able to come into contact with and out of contact with the outer peripheral surface of the cylinder member 31.

The upper surface 321 of the fixing member 32 comes into contact with the outer peripheral surface of the cylinder member 31, so it is formed to have a curvature substantially equal to the curvature of the outer peripheral surface of the cylinder member 31. Therefore, no deformation, etc., of the elastic material sheet occurs when pressing the elastic material sheet wound on the outer periphery of the cylinder member 31.

The fixing member 32 presses the vicinity of the positioning notch 14 of the elastic material sheet to fix the elastic material sheet to the outer periphery of the cylinder member 31 in a state in which the positioning notch 14 of the elastic material sheet and the positioning protrusion 312 are engaged with each other.

The roller means is equipped with a movable part 341 at a basal end side, a shaft 34 provided with an extendable part 342 on the tip end side, a roller 33 attached to the tip end of the extendable part 342 to form the elastic material sheet into a cylindrical shape.

The shaft 34 is provided with a movable part 341 which is rotated by a rotating member on the basal end side, so that the shaft 34 is configured to be movable in a contacting and separating direction with respect to the outer peripheral surface of the cylinder member 31.

The roller 33 is set to have a length substantially equal to the axial length of the cylinder member 31, and is arranged on each of the left and right sides of the cylinder member 31 as viewed in the axial direction.

On both sides of the cylinder member 31 as viewed in the axial direction, frames 35 are provided. Each frame 35 includes a pair of side plates 351 provided on the front surface side and the rear surface side of the cylinder member 31 and a top plate 352 horizontally disposed on the side plates 351 on the front surface side and the rear surface side.

The pair of side plates 351 is arranged so as to sandwich the roller 33 therebetween, and includes elongated holes 355 which are long holes extending in the height direction at symmetrical positions.

The elongated hole 355 is formed into a slightly curved shape in accordance with the curvature of the outer periphery of the cylinder member 31.

The ends of the roller 33 are loosely fitted in the elongated holes 355 of the frames 35 of the fixing means. Each roller 33 is configured to move within the range of the elongated hole 355 while contacting to the outer peripheral surface of the elastic material sheet attached to the cylinder member 31 in accordance with the extension and contraction of the extendable part 342.

The roller 33 moves within the range of the elongated hole 355 so as to press against at least a part of the outer peripheral surface except for the flat portion 311 of the cylinder member 31 from the lower part of the elastic material sheet wound on the cylinder member 31 to the part served as the curved portion 15 to thereby process the elastic material sheet into a cylindrical shape.

When attaching the elastic material sheet to the cylinder member 31 and when removing the formed printing plate 1 from the cylinder member 31, in order to form a gap between the roller 33 and the outer peripheral surface of the cylinder member 31, the roller 33 is moved to the lowermost position of the elongated hole 355.

Since the roller 33 is moved along the outer peripheral surface of the cylinder member 31 except for the flat portion 311, when forming the elastic material sheet into a cylindrical shape, the roller 33 moving along the outer peripheral surface of the cylinder member 31 does not move on the flat portion 311 of the cylinder member 31. Thus, the elastic material sheet can be formed into a high precision cylindrical shape with no dents, etc.

The cylindrically forming apparatus 3 further includes a joining means for joining both end portions 111 and 112 of the elastic material sheet in a state in which both the end portions 111 and 112 of the elastic material sheet are pressed in an overlapped manner at the position of the flat portion 311 with the elastic material sheet pressed by the pressing means.

The pressing means includes a pressing member 36 that presses the portion which serves as the curved portion 15 of the elastic material sheet from the radially outside of the cylinder member 31 with both the end portions 111 and 112 of the elastic material sheet overlapped, and an upper frame 353 to which the pressing member 36 is attached.

The pressing member 36 is formed into, for example, an L-shape in cross-section. The side surface of the pressing member is attached to the upper frame 353 and the lower surface thereof serves as a pressing surface for pressing the part which serves as the curved portion 15.

In the pressing surface, for example, a plurality of elliptical through-holes 361 are formed in an aligned state.

The joining means is equipped with, for example, a joining machine 37 having a welding gun accommodating welding rods for joining both end portions 111 and 112 of the elastic material sheet.

The joining machine 37 is configured to be movable in the axial direction of the cylinder member 31 above the elastic material sheet, and join and fix both end portions 111 and 112 of the elastic material sheet by spot welding, etc., through the through-holes 361 of the pressing surface in a state in which both end portions 111 and 112 of the elastic material sheet which is overlapped are temporarily fixed by being pressed by the pressing member 36.

Since the joining operation is performed in a state in which the portion of the elastic material sheet which serves as the curved portion 15 is pressed, the joining operation can be easily performed without causing shifting of the end portions 111 and 112 of the elastic material sheet.

Further, since the joint portion 13 is joined with both end portions 111 and 112 of the elastic material sheet overlapped, the joint portion has a high bonding strength as compared with the case in which the end faces of the elastic material sheets are welded in an abutted state.

The cylindrically forming apparatus 3 may be provided with a stopper means for suppressing the expansion of the elastic material sheet due to the repulsive force of the elastic material sheet wound on the cylinder member 31.

For example, the frames 35 arranged on both sides of the cylinder member 31 as viewed from the axial direction each have a stopper member 38 as a stopper means.

The stopper member 38 is, for example, a plate member extending in the axial direction of the cylinder member 31, and both the stopper members 38 are arranged on both sides of the cylinder member 31 as viewed in the axial direction so that the tip end portions thereof protrude toward the cylinder member 31 side.

The stopper member 38 is attached, for example, to the top plate 352 of the frame 35 so as to be horizontally movable toward and away from the outer peripheral surface of the cylinder member 31.

The upper surface 381 of the stopper member 38 is arranged to be parallel to the flat portion 311 of the cylinder member 31.

On the lower surface of the stopper member 38, the longitudinal end portion of the stopper member on the cylinder member 31 side is formed into an inclined surface 382 at an angle that comes into contact with the outer peripheral surface of the cylinder member 31.

The inclined surface 382 is configured to fix the elastic material sheet to the cylinder member 31 so as to press against the outer peripheral surface of the cylinder member 31 by coming into contact with the outer periphery of the cylinder member 31 in a state in which the elastic material sheet is attached to the outer periphery of the cylinder member 31.

Since the stopper members 38 are provided on both side portions of the cylinder member 31, the end portions of the elastic material sheet are prevented from being spread in the left and right direction due to the repulsive force acting on the unjoined end portions of the elastic material sheet wound on the cylinder member 31.

When attaching the elastic material sheet to the cylinder member 31 and when removing the formed printing plate 1 from the cylinder member 31, the stopper member 38 is moved away from the cylinder member 31.

As mentioned above, the cylindrical material forming step includes first processing of rounding the elastic material sheet to plastically deform the elastic material sheet until a predetermined processing degree is reached, and second processing of further rounding the elastic material sheet so as to overlap both end portions 111 and 112 of the elastic material sheet into a cylindrical shape. Therefore, by performing the second processing after the elastic material sheet is preliminary deformed so that the elastic material sheet is rounded by the first processing, the repulsive force that causes the elastic material sheet to return to its original shape is reduced.

With this, both the overlapped end portions of the elastic material sheet may be joined only by, for example, welding, thereby making a strong joining force by joining using both adhesive and welding unnecessary, which simplifies the joining operation.

By forming the elastic material sheet stepwise into a cylindrical shape by the first processing and the second processing, it is possible to form the printing plate 1 into a cylindrical shape with high accuracy.

Hereinafter, a method of forming the printing plate 1 into a cylindrical shape using the cylindrically forming apparatus 3 will be described.

A positioning notch 14 is formed at the longitudinal end portion of a rectangular elastic material sheet in which a resin layer serving as a plate section 12 is formed on one surface thereof.

The positioning notch 14 is formed by pressing a punch against a scheduled forming position of the positioning notch 14 of a predetermined elastic material sheet and hitting the punch with a hammer in a state in which the elastic material sheet is fixedly positioned by a jig, etc.

At this time, the positioning notch 14 is formed so as to be provided on the side opposite to the curved portion 15 when the elastic material sheet is formed into a cylindrical shape.

The elastic material sheet in which the positioning notch 14 is formed as described above is formed into a slightly curved shape by being subjected to the first processing.

For example, the elastic material sheet is pressed to be rounded by being sandwiched and pressed between a pair of rolls provided on a roll press machine.

End portions 111 and 112 of the elastic material sheet, each serving as a part of the curved portion 15 of the elastic material sheet, are processed with different processing degrees (different curvatures).

For example, when one end portion 111 side of the elastic material sheet is processed with a higher processing degree than the other end portion 112 side, the one end portion 111 processed with a higher processing degree enters the lower side of the other end portion 112 processed with a lower processing degree, easily causing an overlapped state.

In a state in which the first processing is performed, the elastic material sheet is plastically deformed into a slightly rounded almost cylindrical shape.

Subsequently, the second processing is performed on the elastic material sheet to which the first processing was performed.

For example, the elastic material sheet formed into a substantially cylindrical shape is inserted from the tip end side of the cylinder member 31 of the cylindrical forming apparatus 3 and attached to the outer peripheral surface of the cylinder member 31.

The elastic material sheet is attached to the cylinder member 31 in a state in which the elastic material sheet is positioned with respect to the cylinder member 31 with the positioning notch 14 fitted to the positioning protrusion 312 of the cylinder member 31.

When the elastic material sheet is positioned, the fixing member 32 provided below the cylinder member 31 is lifted up so as to come into contact with the elastic material sheet and pressed against the cylinder member 31 to fix the elastic material sheet.

The fixing member 32 is provided so as to press the cylinder member 31 at the vicinity of the positioning notch 14 fitted to the positioning protrusion 312.

The elastic material sheet will not be displaced in the circumferential direction since the positioning notch 14 is engaged with the positioning protrusion 312. Furthermore, the elastic material sheet also will not be displaced in the axial direction since the elastic material sheet is fixed by the fixing member 32.

At this point, both the end portions 111 and 112 of the elastic material sheet remain as unjoined free ends.

The roller 33 standing by on the left and right sides at the lower side of the cylinder member 31 ascends to move along the outer periphery of the cylinder member 31, so that the elastic material sheet is formed into a cylindrical shape.

For example, the roller 33 moves up from the lower side of the cylinder member 31 near to the position where the stopper member 38 is provided to perform the second processing on the elastic material sheet in a state in which the roller 33 is in contact with the elastic material sheet wound on the outer periphery of the cylinder member 31.

As the roller 33 gradually moves along the outer periphery of the cylinder member 31, the shape of the elastic material sheet approaches a cylindrical shape.

When the roller 33 is moved up near to the position of the stopper member 38, for the purpose of suppressing the repulsive force causing the elastic material sheet to return to its original shape, the stopper member 38 provided at the cylindrically forming apparatus 3 is moved close to the cylinder member 31 to press against the outer peripheral surface of the cylinder member 31 to thereby fix the vicinity of the end portion side of the elastic material sheet.

In this state, the pressing member 36 positioned above the cylinder member 31 is lowered so that the overlapped both end portions 111 and 112 (the portion which serves as the curved portion 15 of the elastic material sheet) of the elastic material sheet are pressed in a provisionally fixed state by the pressing member 36.

The joining process is performed in a state in which the portion of the elastic material sheet serving as the curved portion 15 is temporarily fixed by the pressing member 36.

The gun of the joining machine 37 joins both end portions of the elastic material sheet while moving in the axial direction of the cylinder member 31 above the elastic material sheet and performing spot welding through the through-holes 361 of the pressing member 36.

The part to be pressed by the pressing member 36 is a part including the joint portion 13 and having a width dimension substantially equal to the width dimension of the flat portion 311 of the cylinder member 31, and is a curved portion 15 set to have a curvature lower than the curvature of the portion not pressed by the pressing member 36.

At each of both ends of the curved portion 15, a bent portion 15*a* is formed in which bending occurs due to the curvature of the curved portion 15 different from the curvature of the surface continuing to the curved portion 15.

In this way, a printing plate 1 formed into a cylindrical shape is obtained.

It should be noted that as long as the printing plate 1 of the present invention can be obtained by performing the same processing as described above, it is not limited to using the cylindrically forming apparatus 3 as described above.

In the above described cylindrically forming apparatus 3, since the elastic material sheet can be positioned in the circumferential direction with respect to the cylinder member 31 by the positioning notch 14 and further the elastic material sheet can be fixed by the fixing means, the elastic material sheet will not shift in the circumferential direction even during the processing work by the roller means, the pressing means, and the joining means. Thus, the apparatus is excellent in shape accuracy and can easily perform cylindrical forming processing.

After shaping the elastic material sheet into a cylindrical shape, a print pattern is engraved using a plate cylinder 2 having the same shape as the cylinder member 31 of the cylindrical forming apparatus 3, and printing is performed using the plate cylinder 2 of the same shape. Therefore, the image positioning accuracy is high, registering becomes unnecessary, and the printing plate 1 improved in printing accuracy can be formed.

In the above description, it was explained such that the elastic material sheet is formed into a cylindrical shape through two steps of the first processing and the second processing. However the first processing is not always necessarily required as long as it can be formed into a cylindrical shape by only one processing.

Although the explanation was made to a process of forming the elastic material sheet into a cylindrical shape by using a roll press machine or a cylindrically forming apparatus 3, the above described roll press machine and cylindrically forming apparatus 3 are mere examples, and an elastic material sheet may be processed into a cylindrical shape by using a device other than the above.

The forming method of the printing plate 1 as described above is a forming method of the printing plate 1 to be mounted on the outer periphery of the cylindrical plate cylinder 2. The forming method includes a notch forming step of forming the positioning notch 14 in a rectangular elastic material sheet in which a resin layer to be served as a plate section 12 is formed on one surface, a cylindrical material forming step of rounding the elastic material sheet in which the positioning notch 14 is formed and joining the overlapped both end portions 111 and 112 of the elastic material sheet to thereby form the elastic material sheet into a cylindrical shape, and a plate section engraving step of engraving a printing pattern on a plate section 12 of a cylindrical shaped elastic material sheet. By forming the positioning notch 14 in advance in the elastic material sheet, it is possible to position the elastic material sheet in the circumferential direction with respect to the cylinder member 31, etc., even when forming the printing plate 1 by winding on the cylinder member 31, etc. Therefore, the method is excellent in shape accuracy, and can easily process the elastic material sheet into a cylindrical printing plate 1. Thus, a printing plate 1 improved in printing accuracy can be obtained.

Further, the positioning notch 14 can be formed more easily than forming a positioning notch in a cylindrically formed printing plate 1.

It should be noted that the above described embodiment is a mere example of the present invention and it goes without saying that specific configurations, etc., can be appropriately changed and designed within the scope of achieving the functions and effects of the present invention.

This application claims priority to Japanese Patent Application No. 2014-224282 filed on Nov. 4, 2014, the disclosure content of which is incorporated by reference in its entirety.

The terms and expressions used herein are used for the purpose of description and not of limitation, and are not intended to exclude any equivalents of the features shown and described here and it should be understood that various modifications within the claimed scope of the present invention are allowed.

INDUSTRIAL APPLICABILITY

The present invention can be applied to form a printing plate for printing on a metal can body.

DESCRIPTION OF SYMBOLS

1 printing plate
2 plate cylinder
11 plate body
12 plate section
13 joint portion
14 positioning notch
15 curved portion
15*a* bent portion
31 cylinder member

32 fixing member
33 roller
36 pressing member
37 joining machine
312 positioning protrusion
111, 112 end portion

The invention claimed is:

1. A method of forming a printing plate to be mounted on an outer periphery of a cylindrical plate cylinder, the method comprising:

a notch forming step of forming a positioning notch in a rectangular elastic material sheet having a resin layer serving as a plate section formed on one surface of the elastic material sheet;

a cylindrical material forming step of rolling the elastic material sheet in which the positioning notch is formed with the positioning notch configured to engage with a positioning stepped portion extending from an end stopper of a cylinder member having the same shape as the plate cylinder and joining both end portions of the elastic material sheet in an overlapped state to form a cylindrical shape; and a plate section engraving step of engraving a printing pattern at the plate section of the elastic material sheet formed into a cylinder shape by mounting the elastic material sheet on the plate cylinder.

2. The method of forming a printing plate as recited in claim 1, wherein the positioning notch is provided at a position other than a joint portion in which both the end portions of the elastic material sheet are joined in an overlapped manner.

3. The method of forming a printing plate as recited in claim 1, wherein the cylindrical material forming step includes:

first processing of rounding the elastic material sheet to plastically deform until a predetermined processing degree is reached; and second processing of further rounding the elastic material sheet to overlap both end portions of the elastic material sheet into a cylindrical shape.

4. The method of forming a printing plate as recited in claim 3, wherein in the first processing, the elastic material sheet is plastically deformed until a diameter of the elastic material sheet, after the joining, becomes about 1.2 times or more and about 3 times or less.

5. The method of forming a printing plate as recited in claim 3, wherein the first processing is performed such that a processing degree is set to be different between one end portion side and the other end portion side of the elastic material sheet.

6. The method of forming a printing plate as recited in claim 1, wherein at both side portions of a joint portion where both end portions of the cylindrically shaped elastic material sheet are overlapped and joined, bent portions are provided at a distance approximately equal to a width dimension of a flat portion formed by removing a part of an outer periphery of the plate cylinder along an axial direction, and wherein the printing plate and the plate cylinder are positioned by the bent portions and the flat portion.

7. The method of forming a printing plate as recited in claim 6, wherein the positioning notch is provided at a portion other than a portion between the bent portions including the joint portion.

8. The method of forming a printing plate as recited in claim 1, further comprising a fixing step of fixing the elastic sheet material to the plate cylinder by pressing a vicinity of the positioning notch of the elastic sheet material to engage with a positioning protrusion.

9. The method of forming a printing plate as recited in claim 1, wherein the notch forming step occurs before the joining of the end portions of the elastic material sheet in an overlapped state.

* * * * *